US005412545A

United States Patent [19]

Rising

[11] Patent Number: 5,412,545

[45] Date of Patent: May 2, 1995

[54] HEAD AND HIP MOUNTED FLASHLIGHT HOLDING DEVICE

[75] Inventor: Brett R. Rising, 491 E. 319 St., Willowick, Ohio 44095

[73] Assignee: Brett R. Rising, Willowick, Ohio

[21] Appl. No.: 18,153

[22] Filed: Feb. 16, 1993

[51] Int. Cl.[6] ..... F21L 15/14

[52] U.S. Cl. ..... 362/105; 362/191; 362/388; 362/427; 224/151; 224/181; 224/197; 224/250; 224/901

[58] Field of Search ..... 362/103, 105, 106, 190, 362/191, 388, 427; 224/181, 222, 224, 250, 267, 901, 904, 197, 200, 151

[56] References Cited

U.S. PATENT DOCUMENTS

| | | | |
|---|---|---|---|
| 1,274,263 | 7/1918 | Hamilton | 362/105 |
| 1,318,850 | 10/1919 | De Yong | 224/197 |
| 1,530,402 | 9/1924 | Parker | 362/105 |
| 2,421,643 | 6/1947 | Ostli | 362/106 |
| 2,765,398 | 4/1954 | Mays | 362/105 |
| 3,069,538 | 12/1962 | Hobson | 362/105 |
| 3,107,833 | 10/1963 | Vaughn | 224/197 |
| 3,259,271 | 5/1966 | Albrtton | 221/36 |
| 3,550,824 | 12/1970 | Bohanski | 224/197 |
| 4,214,688 | 7/1980 | Griffin, Jr. | 224/197 |
| 4,360,930 | 11/1980 | Blanchard | 2/209.2 |
| 4,420,104 | 12/1983 | DiIenno | 224/250 |
| 4,462,064 | 7/1984 | Schweitzer | 362/105 |
| 4,545,414 | 10/1985 | Baum | 224/224 |
| 4,676,419 | 6/1987 | Victor | 224/901 |
| 4,718,126 | 1/1988 | Slay | 224/181 |
| 4,729,499 | 3/1988 | Fields | 224/181 |
| 4,794,496 | 12/1988 | Lanes | 362/105 |
| 4,887,194 | 12/1989 | Fields | 362/105 |
| 4,970,631 | 11/1990 | Marshall | 362/105 |
| 5,034,862 | 7/1991 | Liston | 362/105 |
| 5,045,979 | 9/1991 | Stevens | 362/103 |
| 5,053,932 | 10/1991 | Case | 362/105 |
| 5,102,024 | 4/1992 | Boersma et al. | 224/181 |
| 5,117,510 | 6/1992 | Broussard | 2/209.2 |

FOREIGN PATENT DOCUMENTS

| | | | |
|---|---|---|---|
| 677791 | 7/1939 | Germany | 362/105 |

*Primary Examiner*—Ira S. Lazarus
*Assistant Examiner*—Alan B. Cariaso

[57] ABSTRACT

This invention is a device which holds a small cylindrical flashlight alongside the head of the wearer, and folds into a sheath for the flashlight when the flashlight is not being used. This device consists of a main strap which is wrapped around the head and secured with complementary hook and loop tape on each overlapping end. The flashlight is held in a holder which is attached to the main strap by a snap set and pieces of complementary hook and loop tape. The holder can be adjusted to any position in the vertical axis. This device has a set of tabs that wrap around the folded main strap in a perpendicular manner, holding the folded main strap and holder into sheath form by attaching complementary hook and loop tape located on the overlapping tab ends. The flashlight mounting unit with 360 degree swiveling capabilities is also designed so that it can be mounted onto a hat or any other chosen surface by a common fastening element compatible to the chosen surface area and the flashlight mounting unit.

8 Claims, 5 Drawing Sheets

HEAD AND HIP MOUNTED FLASHLIGHT HOLDING DEVICE

BACKGROUND OF INVENTION

This invention relates to a body supported flashlight holding device, specifically to a head and hip mounted flashlight holding device. There has been a problem in the past with not having an efficient means to provide portable lighting to an area one chooses to illuminate, without using one hand to hold the flashlight. It is better to have both hands free under most circumstances, than to have one hand occupied with a flashlight. Some individuals would choose to hold the flashlight in their mouth while shining it in the desired direction. This method of approach is quite uncomfortable and cannot be sustained for long periods of time. Others might choose to hold the flashlight between their arm and the side of their chest, but this approach is awkward because the user cannot relax his arm for fear that the flashlight might fall to the ground.

People have tried to solve this dilemma using various body supported apparatuses. U.S. Pat. Nos. 3,069,538 to Hobson, Dec. 18, 1962, 4,794,496 to Lanes Dec. 27, 1988, 1,530,402 to Parker, Sept. 12, 1924, 4,462,064 to Schweitzer Jul. 24, 1984, 5,053,932 to Case Oct. 1, 1991, 5,117,510 to Broussard Jun. 2, 1992, 4,887,194 to Fields Dec. 12, 1989, 4,718,126 to Slay Jan. 12, 1988, and 4,729,499 to Fields Mar. 8, 1988, are devices which do not have the full 360 degree vertical axis positioning, nor do they have means to be folded into a compact sheath that can be worn as a holster mounted on the hip of the wearer. These devices also do not provide a flashlight mounting unit with 360 degree swiveling capabilities, which can be used as a separate working unit for fastening on a chosen surface by a common fastening element.

U.S. Pat. Nos. 3,259,271 to Albritton May 13, 1966, 4,360,930 to Blanchard Nov. 30, 1980, are devices in which the flashlight can be pivoted in the vertical direction and the strap can be wrapped around the flashlight; thus keeping it out of the way when stored. These inventions do not have an efficient means of securing the flashlight in the chosen vertical direction. The strapping may be wrapped around but it is not organized and cannot be worn efficiently on the belt when not being used as a hands-free flashlight operation. These devices also do not provide a flashlight mounting unit with 360 degree swiveling capabilities, which can be used as a separate working unit for affixing on a compatible surface area.

U.S. Pat. Nos. 2,421,643 to Ostli Jun. 3, 1947, and 2,765,398 to Mays Apr. 16, 1954 have cumbersome chin straps to stabilize devices, which is an added discomfort. These devices do not rotate 360 degrees in the vertical axis nor do they fold into an organized bundle that can be stored neatly or worn on the belt around the hip of the wearer. These devices also do not provide a flashlight mounting unit with 360 degree swiveling capabilities, which can be used as a separate working unit for mounting by common fastening elements on a compatible surface.

Timothy Marshall U.S. Pat. No. 4,970,631 Nov. 13, 1990 provides an interesting apparatus for holding the flashlight alongside the head. While this device does adjust somewhat in the vertical axis, it is limited to the degree that once the non-light emitting end of the flashlight is swiveled far enough it can't be attached to the securing block. It will lose its stability, flop around and not hold its position. This device also does not provide for an organized way of holding the device in sheath form to be worn on the belt on the hip of the wearer. Additionally, this device does not provide a flashlight mounting unit with 360 degree swiveling capabilities, which can be used as a separate working unit for mounting on a compatible surface.

U.S. Pat. Nos. 5,034,862 to Liston Jul. 23, 1991 provides a band with a plurality of strap sets used singularly or in plurality to provide for a certain amount of vertical adjustability when the band is worn on the head of the user. This method of solving vertical adjustability does not offer ease of adjustment. One would have to slide the flashlight out of the straps and use one hand to hold the straps out and the other hand to hold the flashlight while sliding the flashlight into the desired strap or straps. When placing the flashlight at an angle one would use two straps placed in different positions. The angled strap would hold the flashlight angled down while the strap perpendicular to the main band would force the flashlight up, the pressure of the two straps working against each other causing the main band to buckle, thus causing a certain degree of discomfort to the wearer. This plurality of straps does not provide ease of adjustment or a full adjustability in any position of the vertical axis. Liston has noted a alternate way of adjusting the flashlight 360 degrees in any position of the vertical axis. He does this by attaching an elastic strap to a plate with hook or loop tape sewn on the bottom of the plate with the complementary hook or loop tape sewn on the main band, thus allowing 360 degree adjustability by attaching the hook and loop tape together in any position of the vertical axis. This attempt does not offer stability or attaching strength to hold the flashlight because hook and loop tape alone is not sufficient to hold a flashlight securely with normal head movement. Liston's invention also does not fold down neatly into a sheath nor can it be efficiently worn on the belt when not being used as a headband. This device also does not provide a secure and stable flashlight mounting unit, with 360 degree swiveling capabilities, which can be used as a separate working unit for affixing on a compatible surface.

In viewing the prior art we find that none of the previous devices provide a versatile flashlight holding device with a full range of capabilities as this present invention does. This present invention provides 360 degree vertical axis swivelling, while maintaining a firmly held position when the flashlight is at the desired angle. The full circle vertical positioning can be used by joggers who may want to warn rearward approaching motorists of their presence, or hikers who shine the light beam from the flashlight on the path behind them for others to see the path. The strap of the holding device is sufficiently wide to spread pressure of the one-area flashlight attaching mechanism over a wide surface to eliminate any pressure points that can cause discomfort. The prior art does not provide a one-area attaching mechanism which holds the flashlight firmly to the band with an attaching surface covering a large enough area to give the flashlight stability while providing for swivelling. None of the prior art provide efficient means to fold the strap assembly into a neat organized bundle, which can then be worn on the belt as a sheath holding the flashlight, or can be placed neatly in a glovebox of a car, toolbox or backpack.

None of the prior art examples provide all these stated aspects with ease of attaching or detaching the flashlight from the holder. The prior art does not combine all the needed aspects with simplicity of design for ease and economy of manufacturing.

The prior art devices do not provide a flashlight mounting unit with 360 degree swiveling capabilities, which can be used as a seperate working unit, to be affixed by a common fastening element to a chosen compatible surface. Whatever the precise merits, features or advantages of the above cited references, none of them achieves or fulfills the purposes of this present invention.

SUMMARY OF INVENTION

It is an object of this present invention to provide a device that will hold a flashlight to the side of one's head to direct the light within his or someone else's field of vision.

It is an object of this present invention to provide a device that will hold smaller flashlights of varying sizes to the side of the head with the ability to direct the beam of light in any direction of the vertical and horizontal axis.

It is an object of this invention to have a strap which encircles the head with securing means on each end of the strap to secure the strap on the head.

It is an object to attach the holder of the flashlight at one pivotal point on the headband.

It is an object of this invention to secure the flashlight holder firmly in any position of the 360 degree vertical axis.

It is an object of this invention when the strap is not in use that it can be folded down and held securely in the folded position.

It is an object of this invention to be held in folded position securely so it can be attached to a belt when the user wants it as a sheath to hold the flashlight on the hip.

It is an object to make the holder in such a way that the flashlight can be slid out of the holder whenever one would want to hold the flashlight in ones hands. It is an object of this present invention to provide the most versatility while keeping the design easy to manufacture and lightweight for situations where weight needs to be kept to a minimum.

It is an object of this invention to use a commonly available flashlight to use as a light source.

It is an object of this present invention to have the strap held in a securely folded position while the flashlight is still attached, so the entire assembly can be held in the hand as a normal flashlight would be held when it was detached from any headband gear.

It is an object of this present invention to provide a flashlight mounting unit with 360 degree swiveling capabilities which can be used as a seperate working mount for permanently affixing to any chosen compatible surface.

This invention is a device which holds a small cylindrical flashlight alongside the head of the wearer and folds into a sheath for the flashlight when not in use but at ready access. This device consists of a main strap with complementary hook and loop tape pieces on each overlapping end. The flashlight is slipped into a holder which can be attached to the main strap by a snap stud, socket and complementary hook and loop tape pieces. The holder can be adjusted to any position in the vertical axis. This device has two tabs that extend on each side of the holder to wrap around the folded main strap where they are then secured together by complementary hook and loop tape pieces, holding the strap in this position for the device to be used as a flashlight sheath.

The main strap can be made of elastic or nonelastic material, whichever is preferred. In securing the head band to the head of the wearer, a complimentary hook and loop tape would be placed on opposite sides and opposite ends of the strap. Then the strap would overlap until the band is tight on the head of the user and the overlapping complementary hook and loop tape would be clasped together.

A holder assembly for holding the flashlight to the main strap consists of two pieces of similar length material with the holder top piece being wider than the holder bottom piece. The holder top piece is of a width that an arch can be formed in it between two lines of stitching which run along the length of both pieces. The arch is then used for holding the flashlight to the main strap after the flashlight has been inserted into it. The holder top has two ends extending out far enough to be used as sheath-securing tabs, explained later in this document. A snap stud would be centered and crimped on a swatch of loop tape which would then be sewn on to the holder bottom piece outside surface.

The holder is held to the main strap by the holder base assembly. The holder base assembly consists of a piece of material which a snap socket is centered in and crimped to. The base assembly also includes a stabilizing shim with a thickness of the same dimension as the depth of the snap socket. A hole is punched in the shim, of the same diameter as the snap socket. The snap socket is then pushed into the hole with the snap socket holding the material butting up against the undersurface of the stabilizing shim, keeping the snap socket from pulling through the hole. A rectangular piece of loop tape is cut the same width and length as the shim and a whole is cut in the middle a sufficient diameter as to not obstruct the snap socket. The rectangular piece of loop tape is placed on the bearing surface of the base assembly. This whole assembly is sewn onto the main strap, far enough off center of the major axis of the main strap to place the flashlight at the side of the head while the adjusting means is at the back of the head. Complementary snap stud and socket, hook and loop tape from holder, and holder base assembly are joined together to hold the flashlight on the main strap.

This invention is also designed to fold into a sheath for the flashlight when the flashlight is not in use, but with easy access for the wearer. As stated previously, the holder has two tabs or lengths of material to be used to hold the device in sheath form. One tab is slightly longer than the other. Two swatches of the same size loop tape are to be sewn on each side of the shorter tab end. Hook tape of sufficient length for securing device in sheath form is sewn on the inside of the longer tab end. The main strap is folded as follows: The main strap has two sides defined by placing base assembly off center to the major axis of the main strap so the adjusting means would lie at the back of the head with the flashlight above the ear. Then, measuring from the center of the holder base out to each end, one end would be longer than the other, giving a long end main strap short end main strap. With this in mind the folding can be explained. The flashlight's light-emitting end is pointed in the direction of the long end main strap; the first fold is performed by bending the long end main strap in the vicinity of the light-emitting end of the flashlight, folding it 180 degrees, and holding it to the inside of the short end main strap. The second fold is performed by simultaneously folding long end main strap and short end main strap in the vicinity of the non-light emitting end of the flashlight, folding it 180 degrees in the opposite direction of the previous fold. Fold three is performed by taking the first holder tab end, wrapping it around the folded main strap and attaching complementary hook and loop tape on first holder tab end and short end main strap together. Fold four is performed by folding second holder tab end around folded main strap on to outside of first holder tab end and attaching complementary hook and loop tape. Fold five is performed by folding the remaining length of short end main strap 180 degrees towards its outside part until the very end of the short end main strap is even with the edge of holder tabs, and attaching complementary hook of long end main strap and loop tape of folded short end main strap. Fold six is performed by folding remaining long end main strap 180 degrees and attaching to complementary hook tape on exposed outside of short end main strap, bringing the very end of long end main strap up to edge of holder tabs. The device is now in sheath form.

| Part Names for Device | |
|---|---|
| 8 | Head of wearer |
| 9 | Hip of wearer |
| 10 | Headband and holster flashlight holder |
| 11 | Short end main strap |
| 12 | Main strap |
| 13 | Long end main strap |
| 14 | Hook tape |
| 16 | Loop tape |
| 17 | Holder top inside surface |
| 18 | Holder assembly |
| 19 | Holder top outside surface |
| 20 | Snap stud |
| 21 | Loop tape |
| 23 | Loop tape |
| 24 | Snap stud eyelet |
| 25 | Second holder tab end |
| 26 | Holder top piece |
| 27 | First holder tab end |
| 28 | Holder bottom piece |
| 29 | Lines of stitching |
| 30 | Hook tape |
| 31 | Holder bottom inside surface |
| 32 | Holder base assembly |
| 33 | Flashlight mounting unit |
| 34 | Snap socket eyelet |
| 35 | Holder bottom outside surface |
| 36 | Snap socket reinforcement material |
| 38 | Snap socket |
| 40 | Stabilizing shim |
| 42 | Hook tape with hole in center |
| 54 | Flashlight |
| 56 | Flashlight shank |
| 58 | Flashlight flared end |
| 60 | Main strap inside surface |
| 62 | Main strap outside surface |
| 64 | Slot for belt |
| 65 | Belt |
| 66 | Sheath |
| 68 | Baseball cap |

DETAILED DESCRIPTION OF DRAWINGS

Figure 1:
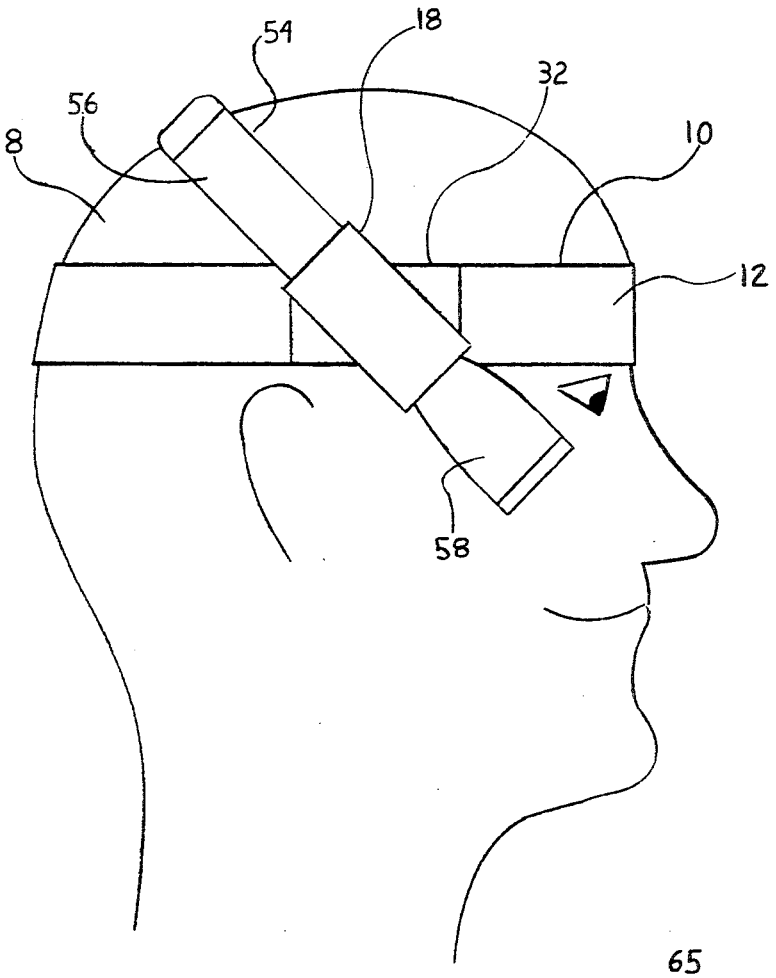
FIG. 1 A general side view of the device with the flashlight held in an angled position showing its swivelling capabilities in vertical direction.

FIG. 1 Shows the flashlight holding device 10 encircling a person's head 8 above the ears and eyes of the person. Flashlight 54 is of the smaller type holding AA or AAA size batteries and of varying lengths usually no more than 9 inches long. Flashlight 54 has a shank 56 that slides into the holder assembly 18 until the flashlight's light-emitting end 58 comes to rest against the side of the holder assembly 18. The shank 56 has a smaller diameter than the flashlight's light-emitting end 58. The device 10 has an elastic or nonelastic main strap 12 that encircles the head of the wearer. The main strap 12 has a holder base assembly sewn to it which is unseen in FIG. 1, which receives the holder assembly 18 with complementary attaching means precisely explained later in description.

Figure 2:
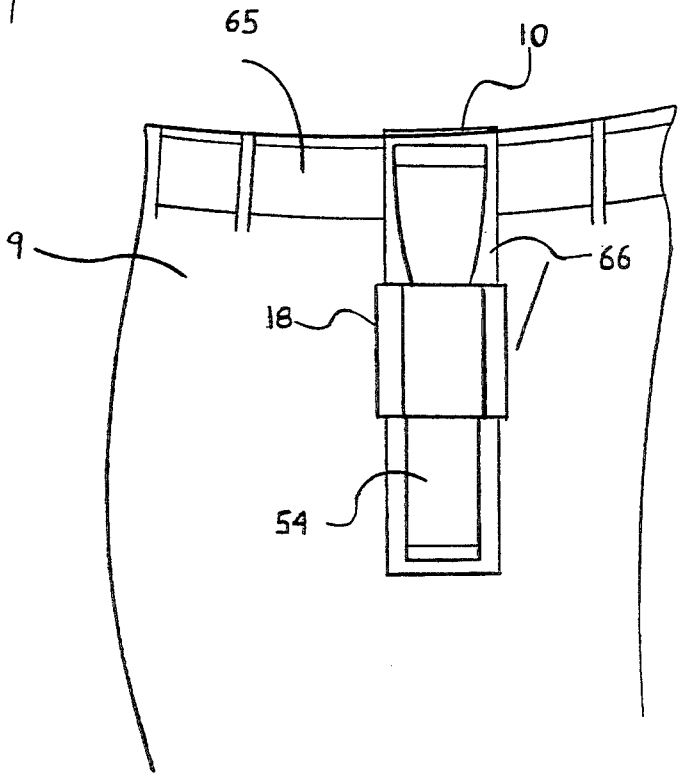
FIG. 2 Device on hip of wearer being used as holster.

FIG. 2 shows the folded device 10 being held on the hip by a belt 65, where the flashlight 54 is at easy access to be slipped out of the holder assembly 18 at any time.

Figure 3:
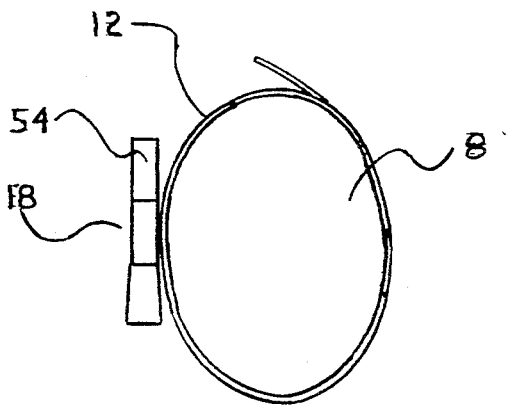
FIG. 3 A top view of the device positioned on wearer's head, showing overlapping of straps that hold the device to the wearer's head.
Figure 4:
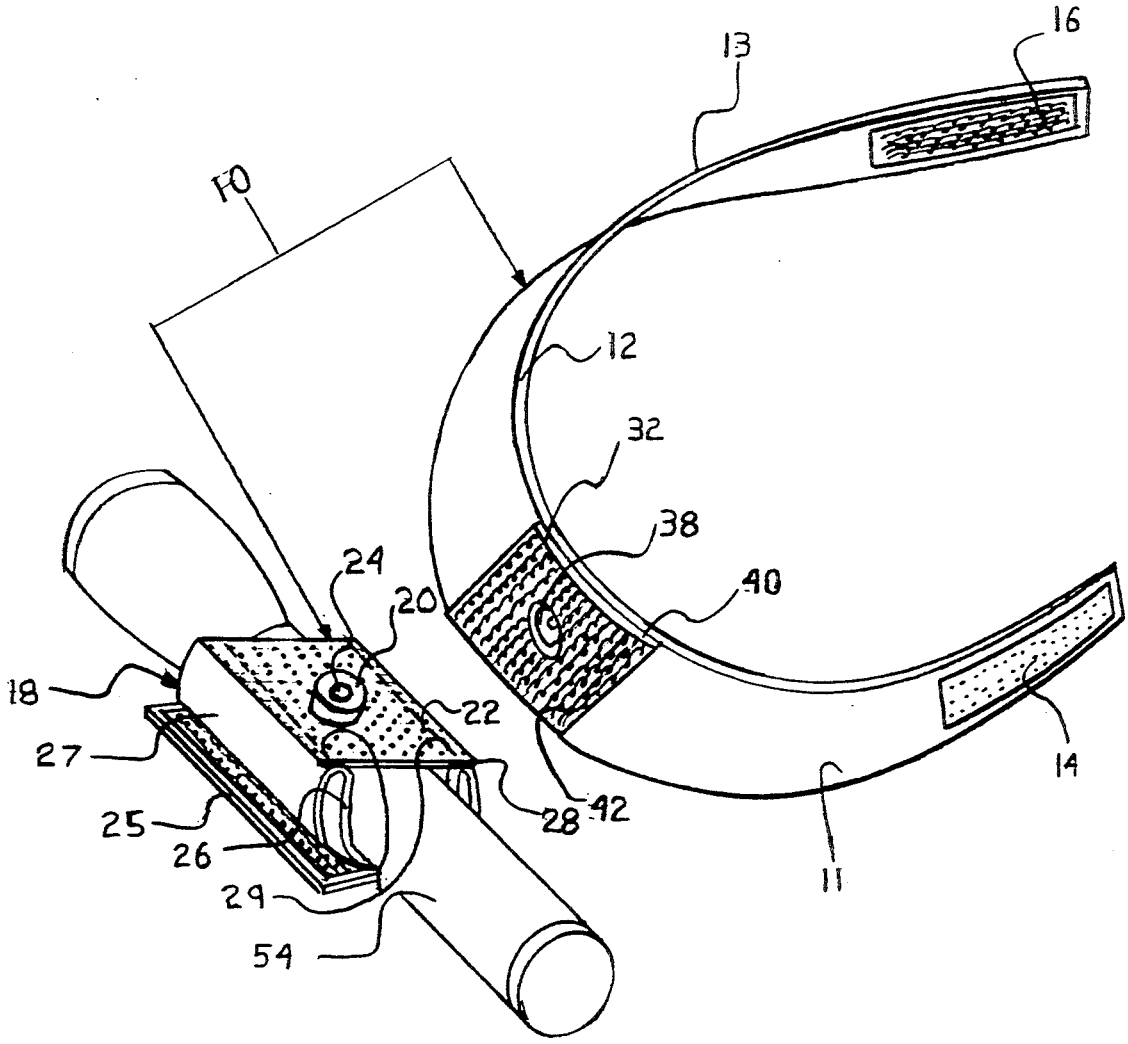
FIG. 4 The flashlight holder assembly broken away from the holder base assembly which is attached to the main strap.
Figure 5:
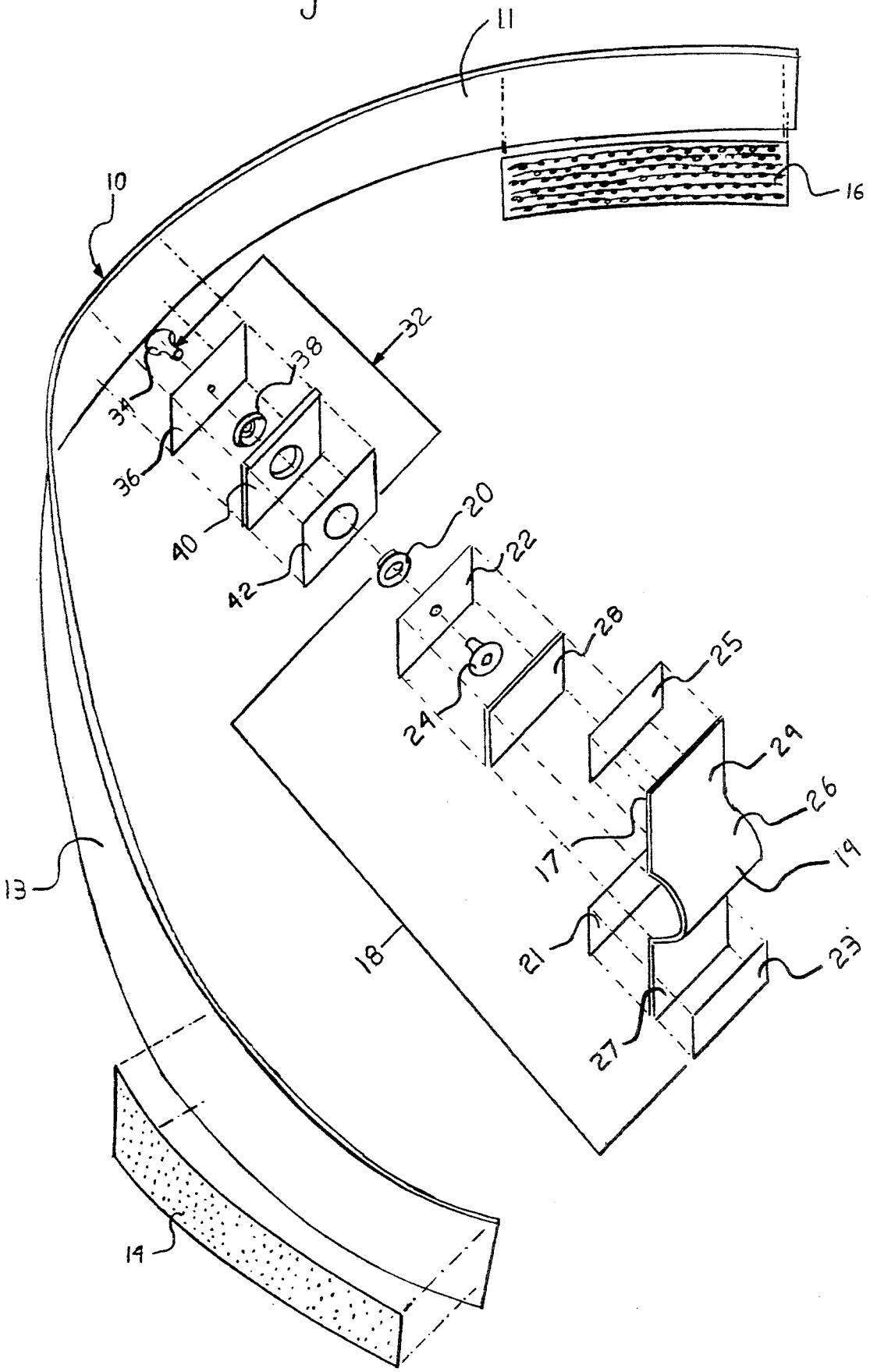
FIG. 5 An exploded view of the main strap, the holder assembly and holder base assembly.

FIG. 3 shows the device 10 around a person's head 8 from the top view. The flashlight 54 is held tightly in the holder assembly 18 which is connected firmly to the holder base assembly 32. This flashlight mechanism can be comfortably adjusted 360 degrees on the horizontal axis around the head. The holder assembly 18 and holder base assembly 32 have complementary hook tape 14 and loop tape 16 sewn to the bearing surfaces and complementary stud 20 and socket 38 snap set (as shown in FIGS. 3, 4 and 5) on their bearing surfaces to fasten the flashlight 54 securely in the position desired. At the back of the head 8 the main strap's 12 overlapping ends attach together by sewing sufficient lengths of complementary hook tape 14 and loop tape 16 to allow for adjustment for a large variety of head sizes.

FIG. 4 is a view of the device 10 with the holder assembly 18 detached from the rest of the body of the device 10. This is done by pulling the flashlight holder assembly 18 with sufficient force to separate the snap stud 20 on flashlight holder assembly 18 from snap socket 38 on holder base assembly 32 and at the same time separating the hook tape 22 sewn on to flashlight holder assembly's bearing surface 18 from the loop tape 42 sewn on holder base assembly's bearing surface 32. The holder assembly can be reattached, in any chosen angular position within the vertical plain, by aligning snap stud 20 and snap socket 38 and pressing holder assembly 18 against holder base assembly 32 with sufficient force to interlock hook tape 14 with loop tape 16 and snap stud 20 to snap socket 38. FIG. 4 shows the main strap 12 with the holder base assembly 32 attached to it. On the bearing surface of the holder base assembly 32 is a piece of loop tape 42 with a hole centered in the loop tape 42, of sufficient size as to not obstruct the snap socket 38 which fits in the hole of the stabilizing shim 40. The stabilizing shim 40 is between the main strap 12 and loop tape 42. The holder base assembly 32 is affixed off center so that the main strap 12 that is extending from the center of holder base out to the end of main strap 12 is the short end main strap 11. The other section of main strap extending from center of holder base 32 to the opposite end of the main strap 12 is the long end main strap 13. The holder base assembly 32 is positioned along the major axis of said main strap 12 so that the flashlight 54 can lie in a normal position above the ear and the tightening or adjusting means is at the back of the head. This is also designed with the holder base assembly 32 positioned from ends so that the device 10 can be folded by a specifically designed sequence of folds (shown later in the specifications) to become an organized, useable and useful flashlight sheath. The short end main strap 11 has a sufficient length of hook tape 14 sewn at the end and on the same side as the holder base 32 or main strap outside surface 62. The loop tape 16 is sewn on the main strap inside surface 60 of long end main strap 13, on the opposite side as the holder base assembly 32 which is on main strap outside surface 62.

FIG. 5 Shows an exploded view of all the components of device 10. Loop tape 16 is sewn on the long end main strap 13 on the main strap inside surface 60 of mainstrap 12. Hook tape 14 is sewn on short end main strap 11 on the main strap outside surface 62. Base assembly 32 has a snap socket eyelet 34 protruding through hole in center of snap socket reinforcement 36 and through the hole in the snap socket 38 where the snap socket eyelet 34 is then crimped holding pieces 34, 66 and 38 together. The stabilizing shim 40 has a hole of the right size to allow snap socket 38 to fit snugly in it, which then brings the snap socket reinforcement material 36 against the nonbearing surface of the stabilizing shim 40. A piece of loop tape 42 with a hole centered in it of sufficient size as to not to obstruct the snap socket, is placed on the bearing surface of the stabilizing shim 40. Pieces 36, 40 and 42 are all then sewn together on main strap 12 at the prescribed distance as described earlier in the description for FIG. 4. For the flashlight holder assembly 18 a holder top piece 26, having a holder top inside surface 17 and a holder top outside surface 19, is cut sufficiently wider than a holder bottom piece 28. The wider holder top piece 26 is placed on the holder bottom piece 28. An arch is formed in the holder top piece 26 and two lines of stitching 29 are run along the length of both pieces as shown in FIG. 4. The holder top piece 26 and holder bottom pieces 28 inside surfaces 17 and 24 come in contact with flashlight shank 56. Outside surfaces 19 and 35 of the holder top piece 26 and holder bottom piece 28, face away from flashlight shank 56. The two ends of the holder top piece 26 extend out past the lines of stitching far enough to be used as holder tabs 25 and 27 which will hold the folded main strap 12 in sheath 66 form. One holder tab is slightly longer than the other, resulting in a second holder tab end 25 and a first holder tab end 27. Two swatches of the same size loop tape 21 and 23 are to be sewn on each side of first holder tab end 27. Hook tape 30 of sufficient length for securing device in sheath 66 form is sewn on inside of second holder tab end 25. The snap stud eyelet 24 which protrudes through the small hole in the backside of hook tape 22 and then through hole in snap stud 20, where the eyelet 24 is then crimped holding pieces 20, 22 and 24 together. The hook tape 22 with snap stud 20 fastened to it is sewn on the holder bottom outside surface 35 with the snap stud 20 facing away from the holder bottom outside surface 35. Flashlight holder assembly 18 can now be joined to holder base assembly 32 in any angular position within the vertical plain by pressing snap socket 38, snap stud 20, hook tape 22, and loop tape 42 together.

Figure 6:
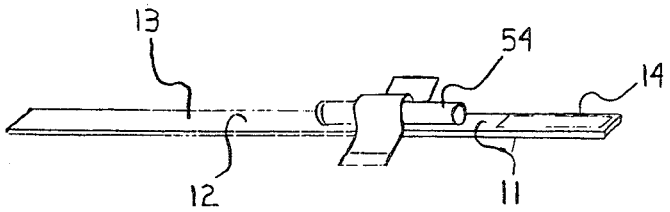
FIGS. 6–13 A sequence of views showing how to fold the device into sheath form and how to slide it on a belt.
Figure 7:
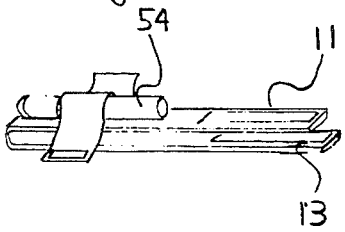
Figure 8:
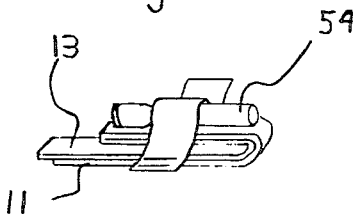
Figure 9:
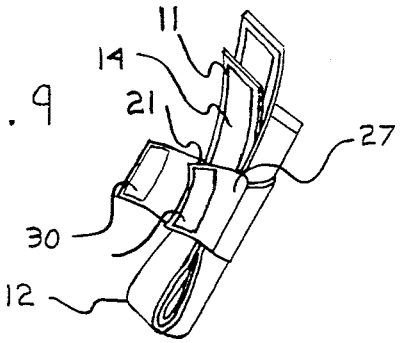
Figure 10:
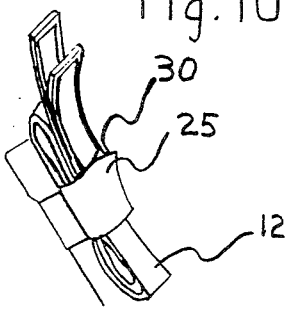
Figure 11:
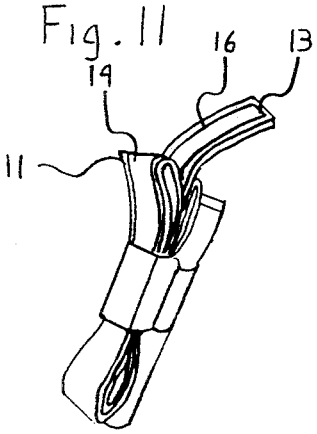
Figure 12:
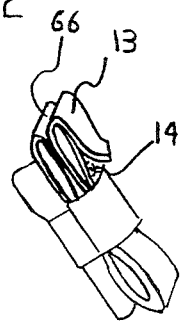
Figure 13:
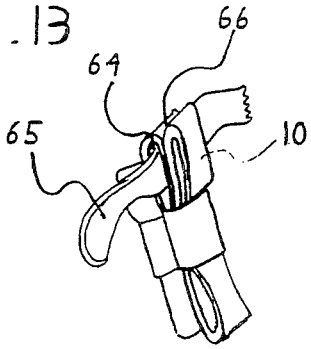
Figure 14:
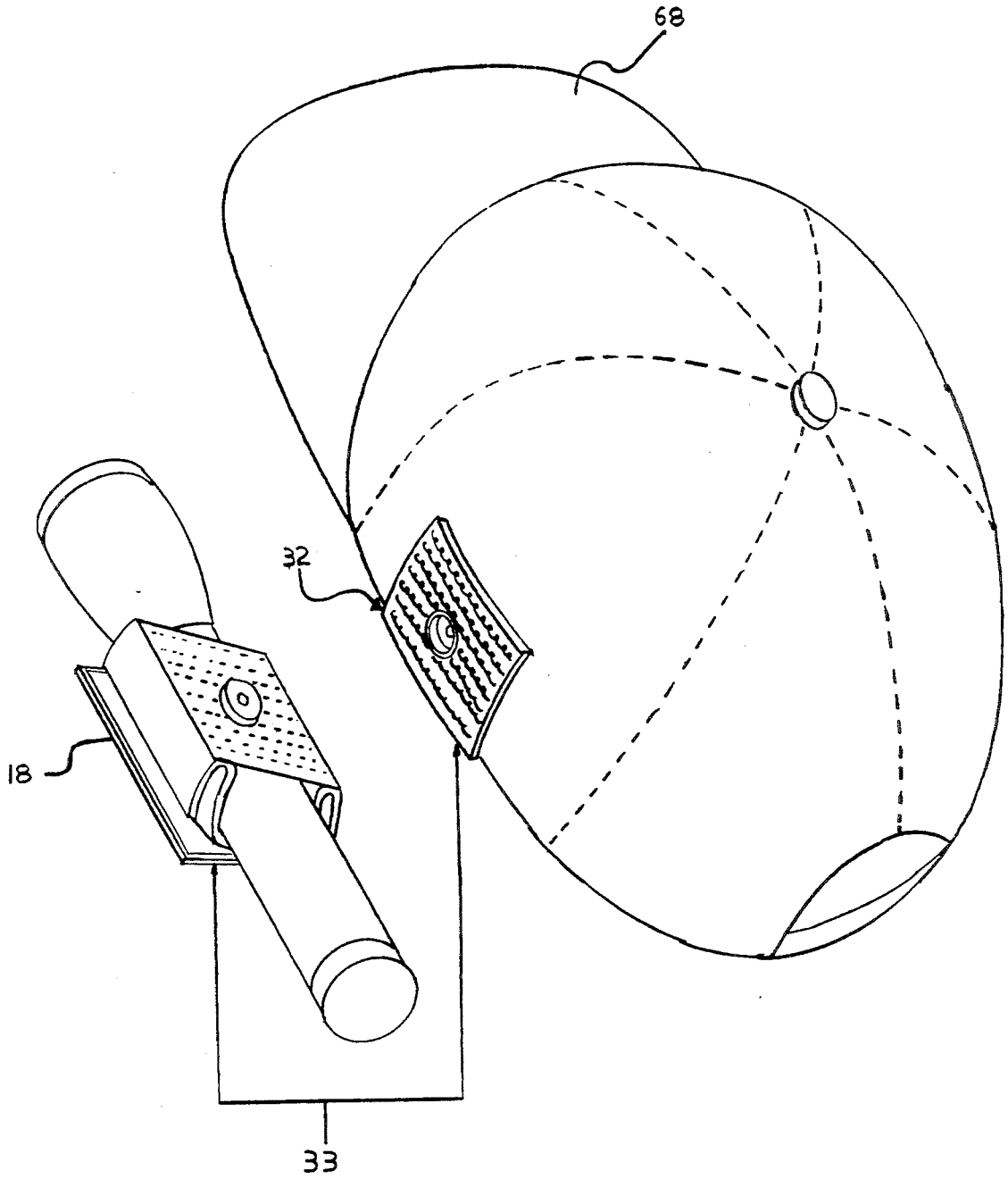
FIG. 14 The flashlight's holder assembly separated away from holder base assembly, while the holder base assembly is affixed to the surface of the side of a common baseball cap.

This device 10 is also designed to fold into a sheath 66 for the flashlight 54 when flashlight 54 is not in use but with easy access for the wearer. The main strap 12 has two sides defined by measuring from the center of the holder base assembly 32 out to each end. When the measurements are taken, one side would be longer than the other, giving a long end main strap 11 and a short end main strap 13. With this in mind the folding can be explained. FIG. 6 shows the flashlight's 54 light-emitting end pointed in the direction of the long end main strap 13. Fold 7 is performed by bending the long end main strap 13 in the vicinity of the light-emitting end of the flashlight 54 and folding it 180 degrees and abutting it to the inside of short end main strap 11. Fold 8 is performed by simultaneously folding long end main strap 13 and short end main strap 11 in the vicinity of the non-light emitting end of flashlight 54, 180 degrees in the opposite direction of previous fold. Fold 9 is performed by taking first holder tab end 27, folding it around folded main strap 12, and attaching complementary loop tape 21 on first holder tab end 27 and hook tape 14 of short end main strap 11. Fold 10 is performed by folding second holder tab end 25 around folded main strap 12 and attaching hook tape 30 of second holder tab end 25 to loop tape 23 of first holder tab end 27. Fold 11 is performed by folding remaining length of short end main strap 11, 180 degrees towards main strap long end 13 until the end of short end main strap 11 is attached by complementary hook tape 14 to loop tape 16 of long end main strap 13. Fold 12 is performed by folding remaining long end main strap 13, 180 degrees and attaching loop tape 16 to complementary hook tape 14 on exposed outside of short end main strap 11. The device 10 is now in sheath 66 form. View 13 shows the folded sheath 66 of device 10 being slipped on to the end of a belt 65 by the open slot 64, created by the folding of the main strap 12. The flashlight 54 is now readily accessible from a hip mounted sheath 10. FIG. 14 shows the flashlight mounting unit 33 with the flashlight 54 and holder assembly 18 detached from holder base assembly 32. The base assembly 32 is shown affixed, by a common fastening element such as stitching, to the side surface of a common baseball cap 68.

Operations

To mount device 10 on the head 8 of wearer one would take and hold short end main strap 11 against back of head 8 with one hand and with the other hand grasp long end main strap 13, wrapping the long end main strap 13 all the way around head 8 and attaching the two ends at the back of head with complementary hook tape 14 and loop tape 16. To adjust flashlight 54 on the vertical plain axis one would grasp the holder assembly 18 with one hand and with the other hand grasp holder base assembly 32, twisting up or down on holder assembly 18.

This device 10 is also designed to fold into a sheath 66 for the flashlight 54 when the flashlight 54 is not in use but with easy access for the wearer. The main strap 12 has two sides defined by measuring from the center of the holder base 32 out to each end. When the measurements are taken one side would be longer than the other giving a long end main strap 11 and a short end main strap 11. With this in mind the folding can be explained. FIG. 6 shows the flashlight 54 light-emitting end is pointed in the direction of the long end main strap 13. Fold 7 is performed by bending the long end main strap 13 in the vicinity of the light-emitting end of the flashlight 54 and folding it 180 degrees and abutting it to the inside of short end main strap 11. Fold 8 is performed by simultaneously folding long end main strap 13 and short end main strap 11 in the vicinity of the nonlight-emitting end of flashlight 54, 180 degrees in the opposite direction of previous fold. Fold 9 is performed by taking first holder tab end 27 folding it around folded main strap 12 and attaching complementary hook tape 23 and loop tape 30 on first holder tab end 27 and short end main band 11. Fold 10 is performed by folding first tab end 29 around folded main strap 12 on to second holder tab end 27 and attaching complementary hook tape 25 and loop tape 23. Fold 11 is performed by folding remaining length of short end main strap 27 180 degrees towards its outside part until the very end of short end main strap 23 is even with the edge of holder tabs 27 and 29, and then attaching complementary hook tape 14 of long end main strap 13 and loop tape 16 of folded short end main strap 11. Fold 12 is performed by folding remaining long end main strap 13, 180 degrees and attaching loop tape 16 to complementary hook tape 14 on exposed outside of short end main strap 11. The device 10 is now in sheath 66 form. View 13 shows the folded sheath of device 10 being slipped on to the end of a belt 65 by the open slot 64, created by the folding of the main strap 12. The flashlight 54 is now readily accessible from a hip mounted sheath 66.

Thus the reader will see that this invention has a reliable structure and provides a lightweight but useful and economical device which can be used in a wide variety of circumstances. While my above description contains many specific details these should not be misunderstood as limitations on the scope of the invention, but as an example of a preferred embodiment of the device. This patent application is intended to include modifications and changes which may be included and built upon the following claims.

I claim:

1. A device to hold a flashlight on the head of a person for hands-free use and the same device folded into a sheath to hold the flashlight on the waist of a person comprising:

a.) a flexible main strap to fit around the person's head having a major and minor axis, and an inside and outside part, b.) a first means to adjust said main strap to firmly hold said main strap horizontally around the person's head above the person's eyes, c.) a holder assembly comprising a holder top and holder bottom material joined together to form a sleeve for the flashlight, with a holder top inside surface and a holder bottom inside surface touching said flashlight, and a holder top outside surface and a holder bottom outside surface facing away from said flashlight, said holder bottom having a first fastening element attached to said holder bottom outside surface, d.) a holder base assembly having a second fastening element attached to said main strap for securing said holder assembly to said main strap and distributing the weight of the flashlight over a larger area on said main strap keeping said flexible main strap from twisting, wherein said holder base assembly is positioned along the major axis of center, defining a long end main strap which extends from said holder base assembly's center to one end of said main strap, and a short end main strap which extends from said holder base assembly's center to the other end of said main strap, e.) a pivot means for adjusting said holder assembly 360 degrees in angular position of the vertical plane, and said first and second fastening elements having surfaces abutting each other for securing said holder assembly in any chosen angular position in the vertical plane with respect to said main strap, f.) said holder assembly is attached to said holder base assembly in any angular position within the vertical plane via said pivot means and said first and second fastening elements, g.) first and second holder tab ends, being lengths of material continuing from said holder top, with a set of fastening elements for folding said main strap tightly into said sheath for holding the flashlight on a belt, h.) said holder assembly and said holder base assembly are positioned off center of the major axis of said main strap to coordinate dimensionally the folding of said main strap into said sheath.

2. The device of claim 1 wherein the first means comprises two ends of said main strap overlapping each other and adjustably secured to fit various head sizes by a complimentary hook and loop tape attached to main strap ends.

3. The device of claim 1 wherein the dimensions of said holder top and said holder bottom have the same length, said holder top is wider than said holder bottom, said holder top is placed on said holder bottom with said holder top inside surface and said holder bottom inside surface touching, wherein an arch made in said holder top and lines of stitching run along the length through both said holder top and said holder bottom on each side of the arch forming a sleeve for holding the flashlight, the holder top having said first and said second tab ends extending out past the lines of stitching on either side of the arch, both being of sufficient length to be used as means for holding the device as said sheath for said flashlight.

4. Device of claim 1 wherein said first fastening element of said holder assembly comprises a hook tape, a portion of said pivot means comprises a snap stud centered and crimped to a swatch of said hook tape, said hook tape is attached to said holder bottom outside surface.

5. Device of claim 1 wherein a portion of said pivot means on said holder base assembly comprises a hole centered in a stabilizing shim of a circumference to encompass a snap socket, said snap socket is centered and crimped on a snap socket reinforcement material and pushed into said hole of said stabilizing shim until said snap socket reinforcement material abuts to an adjacent surface of said stabilizing shim.

6. The device of claim 3 wherein a swatch of hook tape is attached to said holder top inside surface of said first tab end, and two swatches of loop tape are attached respectively to said holder top outside surface and holder top inside surface of said second tab end.

7. The device of claim 5 wherein said second fastening element of said holder base assembly comprises a swatch of hook tape, with a hole centered in the middle, said hook tape is lined up and placed on a surface of said stabilizing shim opposite said snap socket reinforcement material.

8. The device of claim 1 wherein the said main strap is positioned normally with said holder base assembly at the side of the head and said short end main strap being directly behind the head, and said long end main strap circling around the head across the forehead, above the other ear and overlapping said short end main strap at the back of the head.

* * * * *